US012031736B2

(12) United States Patent
Yanagimoto

(10) Patent No.: US 12,031,736 B2
(45) Date of Patent: Jul. 9, 2024

(54) INSPECTION EXECUTION METHOD, MANAGEMENT SERVER, MOBILE TERMINAL, AND REFRIGERANT CYCLE APPARATUS

(71) Applicant: DAIKIN INDUSTRIES, LTD., Osaka (JP)

(72) Inventor: Sou Yanagimoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 224 days.

(21) Appl. No.: 17/430,977

(22) PCT Filed: Feb. 21, 2020

(86) PCT No.: PCT/JP2020/007238
§ 371 (c)(1),
(2) Date: Aug. 13, 2021

(87) PCT Pub. No.: WO2020/175409
PCT Pub. Date: Sep. 3, 2020

(65) Prior Publication Data

US 2022/0136726 A1 May 5, 2022

(30) Foreign Application Priority Data

Feb. 27, 2019 (JP) ..... 2019-034772

(51) Int. Cl.
*F24F 11/49* (2018.01)
*F24F 11/52* (2018.01)

(52) U.S. Cl.
CPC ..... *F24F 11/49* (2018.01); *F24F 11/52* (2018.01)

(58) Field of Classification Search
CPC ..... F24F 11/49; F24F 11/52; F25B 2500/23; F25B 2500/24; F25B 2600/05; F25B 2700/04
See application file for complete search history.

(56) References Cited

U.S. PATENT DOCUMENTS

2009/0114309 A1* 5/2009 Sakai ..... F25B 45/00 62/509
2017/0010014 A1 1/2017 Miyata et al.
2018/0189741 A1 7/2018 Tamura et al.
(Continued)

FOREIGN PATENT DOCUMENTS

GB 2555573 A 5/2018
JP 7-65792 A 7/1995
(Continued)

OTHER PUBLICATIONS

International Preliminary Report of corresponding PCT Application No. PCT/JP2020/007238 dated Sep. 10, 2021.
(Continued)

*Primary Examiner* — Nelson J Nieves
(74) *Attorney, Agent, or Firm* — Global IP Counselors, LLP

(57) ABSTRACT

An inspection execution method is performed by a computer to cause each of a plurality of apparatuses to execute a plurality of inspections. The inspection execution method includes determining an inspection schedule including at least order of the plurality of inspections, and causing the apparatuses to execute the inspections based on the determined inspection schedule.

13 Claims, 10 Drawing Sheets

(56) References Cited

U.S. PATENT DOCUMENTS

| | | | | |
|---|---|---|---|---|
| 2019/0242632 | A1* | 8/2019 | Sakae | F25B 49/005 |
| 2020/0011560 | A1* | 1/2020 | Minamida | G01M 3/00 |
| 2023/0243534 | A1* | 8/2023 | Song | G06N 3/08 62/56 |

FOREIGN PATENT DOCUMENTS

| | | | |
|---|---|---|---|
| JP | 2003-44453 | A | 2/2003 |
| JP | 2004-60943 | A | 2/2004 |
| JP | 2017-53571 | A | 3/2017 |
| JP | 6253675 | B2 | 12/2017 |
| JP | 2018-109951 | A | 7/2018 |
| JP | 2019-28834 | A | 2/2019 |
| WO | 2015/145627 | A1 | 10/2015 |

OTHER PUBLICATIONS

European Search Report of corresponding EP Application No. 20 76 3071.6 dated Mar. 11, 2022.
International Search Report of corresponding PCT Application No. PCT/JP2020/007238 dated May 26, 2020.

* cited by examiner

| ORDER | REFRIGERANT SYSTEM | INSPECTION | REQUIRED TIME | STATE |
|---|---|---|---|---|
| 1 | REFRIGERANT SYSTEM A | WIRING INSPECTION | 10m | NORMALLY ENDED |
| 2 | REFRIGERANT SYSTEM B | WIRING INSPECTION | 10m | NORMALLY ENDED |
| 3 | REFRIGERANT SYSTEM C | WIRING INSPECTION | 15m | NORMALLY ENDED |
| 4 | REFRIGERANT SYSTEM D | WIRING INSPECTION | 15m | NOT ENDED |
| 5 | REFRIGERANT SYSTEM A | SHUTOFF VALVE INSPECTION | 15m | NOT ENDED |
| | | REFRIGERANT FILLING AMOUNT INSPECTION | | NOT ENDED |
| | REFRIGERANT SYSTEM B | SHUTOFF VALVE INSPECTION | | NOT ENDED |
| | | REFRIGERANT FILLING AMOUNT INSPECTION | | NOT ENDED |
| 6 | REFRIGERANT SYSTEM C | SHUTOFF VALVE INSPECTION | 30m | NOT ENDED |
| | | REFRIGERANT FILLING AMOUNT INSPECTION | | NOT ENDED |
| | REFRIGERANT SYSTEM D | SHUTOFF VALVE INSPECTION | | NOT ENDED |
| | | REFRIGERANT FILLING AMOUNT INSPECTION | | NOT ENDED |
| ⋮ | ⋮ | ⋮ | ⋮ | ⋮ |

FIG. 4A

| ORDER | REFRIGERANT SYSTEM | INSPECTION | REQUIRED TIME | STATE |
|---|---|---|---|---|
| 1 | REFRIGERANT SYSTEM A | WIRING INSPECTION | 10m | NORMALLY ENDED |
| 2 | REFRIGERANT SYSTEM B | WIRING INSPECTION | 10m | NORMALLY ENDED |
| 3 | REFRIGERANT SYSTEM C | WIRING INSPECTION | 15m | NORMALLY ENDED |
| 4 | REFRIGERANT SYSTEM C | SHUTOFF VALVE INSPECTION | 30m | NOT ENDED |
| | | REFRIGERANT FILLING AMOUNT INSPECTION | | NOT ENDED |
| 5 | REFRIGERANT SYSTEM A | SHUTOFF VALVE INSPECTION | 15m | NOT ENDED |
| | | REFRIGERANT FILLING AMOUNT INSPECTION | | NOT ENDED |
| | REFRIGERANT SYSTEM B | SHUTOFF VALVE INSPECTION | | NOT ENDED |
| | | REFRIGERANT FILLING AMOUNT INSPECTION | | NOT ENDED |
| PENDING | REFRIGERANT SYSTEM D | WIRING INSPECTION | | SUSPENDED |
| | | SHUTOFF VALVE INSPECTION | | NOT ENDED |
| | | REFRIGERANT FILLING AMOUNT INSPECTION | | NOT ENDED |

FIG. 7

INSPECTION EXECUTION METHOD, MANAGEMENT SERVER, MOBILE TERMINAL, AND REFRIGERANT CYCLE APPARATUS

CROSS-REFERENCE TO RELATED APPLICATIONS

This U.S. National stage application claims priority under 35 U.S.C. § 119(a) to Japanese Patent Application No. 2019-034772, filed in Japan on Feb. 27, 2019, the entire contents of which are hereby incorporated herein by reference.

BACKGROUND

Field of the Invention

The present disclosure relates to an inspection execution method of causing a refrigerant cycle apparatus to execute a plurality of inspections, and a management server, a mobile terminal, and a refrigerant cycle apparatus that implement the inspection execution method.

Background Information

For example, like a method described in Japanese Examined Patent Application Publication No. H7-06579211, there is a method of executing a plurality of inspections in an air conditioning system including a plurality of indoor units and a plurality of outdoor units before application of an operation of the air conditioning system is started.

The present disclosure is to efficiently execute a plurality of inspections in an air conditioning system.

An inspection execution method according to a first aspect is an inspection execution method performed by a computer, for causing each of a plurality of apparatuses to execute a plurality of inspections. The inspection execution method includes a schedule determination step and an inspection step. The schedule determination step determines an inspection schedule including at least order of the plurality of inspections. The inspection step causes the apparatuses to execute the inspections on the basis of the determined inspection schedule.

Accordingly, it is possible to efficiently execute the plurality of inspections.

In an inspection execution method according to a second aspect, which is the inspection execution method according to the first aspect, the inspection schedule is determined to execute one of the inspections with an abnormality response time being long before another one of the inspections with the abnormality response time being short. The abnormality response time is a time required for executing a necessary response when an abnormality occurs in inspection results that are results of the inspections.

In an inspection execution method according to a third aspect, which is the inspection execution method according to the first aspect or the second aspect, the inspections include a first-type inspection and a second-type inspection, the first-type inspection of one of the apparatuses having no influence or a small influence on results of the inspections of the other apparatuses, the second-type inspection having a larger influence than the influence of the first-type inspection. The inspection schedule is determined to concurrently execute the first-type inspection having the small influence.

In an inspection execution method according to a fourth aspect, which is the inspection execution method according to any one of the first aspect to the third aspect, the apparatuses each are a refrigerant cycle apparatus configured such that a plurality of use units are connected to a heat source unit. The inspections include an inspection for a refrigerant filling amount of a refrigerant filled in the refrigerant cycle apparatus and an inspection for wiring to check whether or not wiring for connecting the heat source unit with the plurality of use units is proper.

In an inspection execution method according to a fifth aspect, which is the inspection execution method according to any one of the first aspect to the fourth aspect, the schedule determination step makes a determination on the basis of arrangement information that is information on arrangement of the plurality of apparatuses.

An inspection execution method according to a sixth aspect, which is the inspection execution method according to any one of the first aspect to the fifth aspect, further includes an inspection time prediction step of predicting an inspection time that is a time required for executing each of the inspections. The schedule determination step determines the inspection schedule on the basis of the predicted inspection time.

An inspection execution method according to a seventh aspect, which is the inspection execution method according to any one of the first aspect to the sixth aspect, further includes an inspection result storage step and an inspection result display step. The inspection result storage step stores inspection results that are results of the inspections. The inspection result display step displays the inspection results.

An inspection execution method according to an eighth aspect, which is the inspection execution method according to any one of the first aspect to the seventh aspect, further includes an inspection result judgment step and an inspection suspension step. The inspection result judgment step judges whether or not inspection results are normal. The inspection suspension step suspends the inspections when the inspection results of the inspection result judgment step are not normal.

An inspection execution method according to a ninth aspect, which is the inspection execution method according to any one of the first aspect to the eighth aspect, further includes a schedule change step of changing the inspection schedule on the basis of a progress status of the inspection step.

A management server according to a tenth aspect is a management server connected to a computer for causing each of a plurality of apparatuses serving as refrigerant cycle apparatuses each configured such that a plurality of use units are connected to a heat source unit to execute a plurality of inspections. The management server includes a schedule determination unit and an inspection instruction unit. The schedule determination unit includes at least order of the plurality of inspections. The inspection instruction unit instructs execution of the inspections on the basis of the determined inspection schedule.

Accordingly, it is possible to create the inspection schedule with which the plurality of inspections can be efficiently executed.

A management server according to an eleventh aspect, which is the management server according to the tenth aspect, further includes a storage unit and a verification unit. The storage unit stores verification information with which users who use the management server are verified. The verification unit verifies the verification information with each of the users.

A mobile terminal according to a twelfth aspect is a mobile terminal connected to a computer for causing each of a plurality of apparatuses serving as refrigerant cycle apparatuses each configured such that a plurality of use units are connected to a heat source unit to execute a plurality of inspections. The mobile terminal includes an inspection apparatus designation unit and a display unit. The inspection apparatus designation unit designates the apparatuses that are targets of the inspections. The display unit displays results of the inspections.

A mobile terminal according to a thirteenth aspect, which is the mobile terminal according to the twelfth aspect, further includes a storage unit configured to store verification information for verifying a user who uses the mobile terminal. The verification information includes at least one of individual identification information, a password, mobile terminal identification information, and mobile terminal positional information.

A refrigerant cycle apparatus according to a fourteenth aspect is a refrigerant cycle apparatus in which a plurality of use units are connected to a heat source unit. The refrigerant cycle apparatus includes an execution instruction reception unit, an inspection execution unit, and an inspection result output unit. The execution instruction reception unit receives an inspection instruction for causing the refrigerant cycle apparatus to execute a plurality of inspections. The inspection execution unit executes the inspections when the execution instruction reception unit receives the inspection instruction. The inspection result output unit outputs results of the inspections executed by the inspection instruction unit.

BRIEF DESCRIPTION OF DRAWINGS

FIG. 4A presents an example of an inspection schedule.

FIG. 7 presents an example of a pending schedule.

DETAILED DESCRIPTION OF EMBODIMENT(S)

Figure 1:
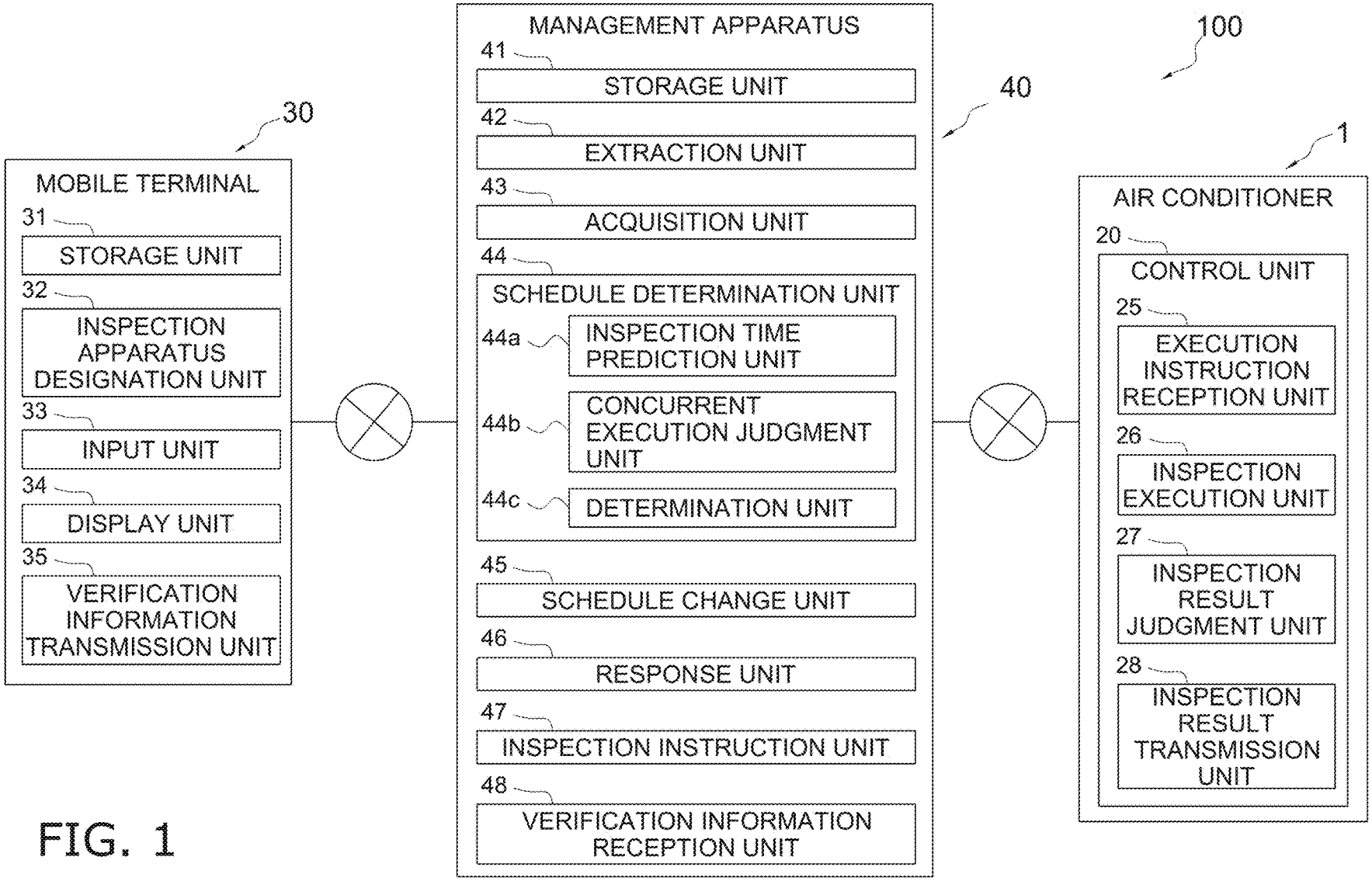
FIG. 1 is a schematic diagram of a schedule creating system.

Hereinafter, a schedule creating system 100 according to an embodiment of the present disclosure is described. The embodiment described below is a specific example, and it is not intend that the embodiment limits the technical scope and the embodiment may be modified in a range not departing from the gist.

(1) Schedule Creating System 100

When a plurality of air conditioners 1 are constructed in a target object, the air conditioners 1 execute a plurality of inspections before application of an air conditioning operation such as cooling or heating is started. The schedule creating system 100 illustrated in FIG. 1 determines the order of executing the respective inspections, and executes each inspection on the basis of the determined order.

The schedule creating system 100 mainly includes apparatuses such as an air conditioner 1, a management server 40, and a mobile terminal 30.

(2-1) Air Conditioner 1

Figure 2A:
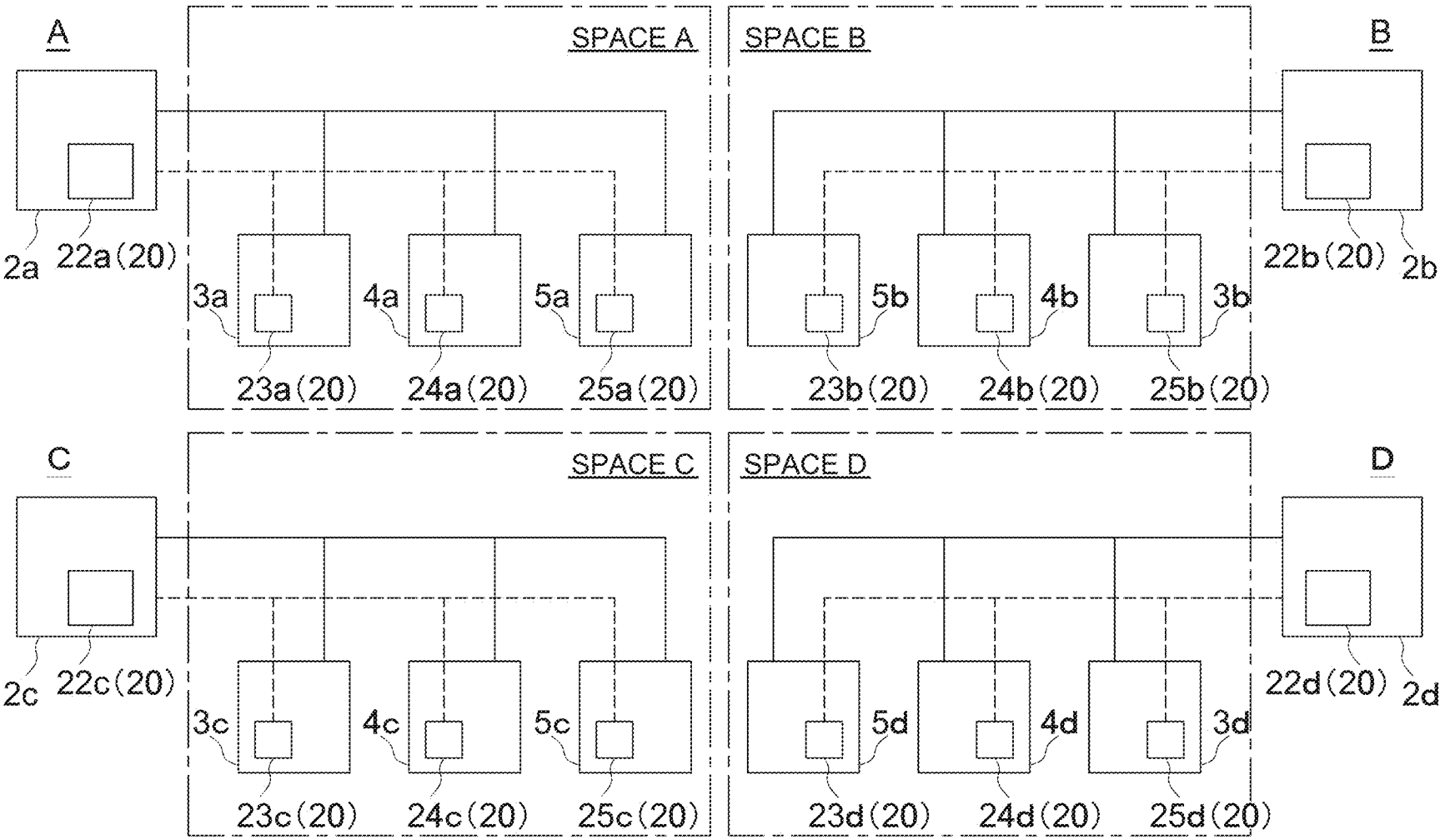
FIG. 2A is a general configuration diagram of an air conditioner.

FIG. 2A is a general configuration diagram of the air conditioner 1. The air conditioner 1 is an apparatus that performs an air conditioning operation such as cooling or heating in a target object. The air conditioner 1 performs the air conditioning operation by performing a vapor compression refrigeration cycle in a refrigerant circuit.

The air conditioner 1 includes a plurality of refrigerant systems. In this embodiment, the air conditioner 1 includes four refrigerant systems of a refrigerant system A, a refrigerant system B, a refrigerant system C, and a refrigerant system D. In the refrigerant system A, an outdoor unit 2*a* serving as a heat source unit is connected to indoor units 3*a*, 4*a*, and 5*a* serving as a plurality of use units to perform an air conditioning operation for a space A. In the refrigerant system B, an outdoor unit 2*b* is connected to indoor units 3*b*, 4*b*, and 5*b* to perform an air conditioning operation for a space B. In the refrigerant system C, an outdoor unit 2*c* is connected to indoor units 3*c*, 4*c*, and 5*c* to perform an air conditioning operation for a space C. In the refrigerant system D, an outdoor unit 2*d* is connected to indoor units 3*d*, 4*d*, and 5*d* to perform an air conditioning operation for a space D.

The air conditioner 1 includes outdoor control units 22*a* to 22*d* respectively provided in the outdoor units 2*a* to 2*d*, and a plurality of indoor control units 23*a* to 25*a*, 23*b* to 25*b*, 23*c* to 25*c*, and 23*d* to 25*d* respectively provided in the indoor units 3*a* to 5*a*, 3*b* to 5*b*, 3*c* to 5*c*, and 3*d* to 5*d*. The outdoor control units 22*a* to 22*d* are connected to the plurality of indoor control units 23*a* to 25*a*, 23*b* to 25*b*, 23*c* to 25*c*, and 23*d* to 25*d* communicably via electric wires.

The outdoor units 2*a* to 2*d* are installed outside a target object. Although not illustrated, the outdoor units 2*a* to 2*d* each include, as elements constituting a refrigerant circuit, a plurality of refrigerant pipes, a compressor, an outdoor heat exchanger, a shutoff valve, and various sensors such as a temperature sensor and a pressure sensor.

The indoor units 3*a* to 5*a*, 3*b* to 5*b*, 3*c* to 5*c*, and 3*d* to 5*d* are ceiling embedded air conditioning indoor units that are installed in ceilings of the target object, or ceiling hung air conditioning indoor units that are installed near ceilings. Although not illustrated, the indoor units 3*a* to 5*a*, 3*b* to 5*b*, 3*c* to 5*c*, and 3*d* to 5*d* each include, as elements constituting a refrigerant circuit, an indoor heat exchanger, a shutoff valve, and various sensors such as a temperature sensor and a pressure sensor.

The outdoor control units 22*a* to 22*d* and the indoor control units 23*a* to 25*a*, 23*b* to 25*b*, 23*c* to 25*c*, and 23*d* to 25*d* constitute a control unit 20 for controlling the air conditioner 1.

As illustrated in FIG. 1, the control unit 20 is connected to a wired or wireless network, and transmits and receives signals to and from the mobile terminal 30, the management server 40, and other apparatuses connected to the same network.

The control unit 20 includes an execution instruction reception unit 25, an inspection execution unit 26, an inspection result judgment unit 27, and an inspection result output unit 28, as functional units illustrated in FIG. 1.

The execution instruction reception unit 25 receives an inspection instruction including information indicative of that an inspection is executed from the management server 40. The inspection instruction includes information for executing each inspection, such as information on a refrigerant system in which an inspection is to be executed and information on an inspection to be executed.

When the execution instruction reception unit 25 receives an execution instruction, the inspection execution unit 26 performs processing of causing the air conditioner 1 to execute an inspection on the basis of the execution instruction. When the execution instruction reception unit 25 receives a plurality of execution instructions, the inspection execution unit 26 can concurrently execute inspections for different refrigerant systems.

The inspection result judgment unit 27 determines whether or not each detection value of a sensor or the like acquired in the inspection being executed by the inspection execution unit 26 is normal, and generates result information. The result information includes normal information in a case where each detection value of the inspection executed by the inspection execution unit 26 is normal, and abnormal information in a case where each detection value of the inspection executed by the inspection execution unit 26 is abnormal. When the inspection result judgment unit 27 acquires the abnormal information, the inspection result judgment unit 27 performs processing of suspending the inspection being executed by the air conditioner 1.

The inspection result output unit 28 transmits the result information acquired by the inspection result judgment unit 27 to the management server 40.

(2-2) Inspection

Each inspection to be executed by the air conditioner 1 is described. In this embodiment, the refrigerant systems A, B, C, and D of the air conditioner 1 each execute three inspections of a wiring inspection, a shutoff valve inspection, and a refrigerant filling amount inspection. Inspections are not limited to the above-mentioned inspections. Another inspection may be added, or any one of the above-mentioned inspections may be skipped.

Each inspection is executed after the refrigerant circuit of the air conditioner 1 is constructed in the target object and a wiring connection work of connecting electric wires of the outdoor control units 22*a* to 22*d* and the indoor control units 23*a* to 25*a*, 23*b* to 25*b*, 23*c* to 25*c*, and 23*d* to 25*d* is completed.

Each inspection is executed by a predetermined method including a known technique. Hereinafter, specific examples for inspection methods of the wiring inspection, the shutoff valve inspection, and the refrigerant filling amount inspection are described with the refrigerant system A. Of course, the inspection method is not limited to the specific examples.

(2-2-1) Wiring Inspection

Figure 2B:
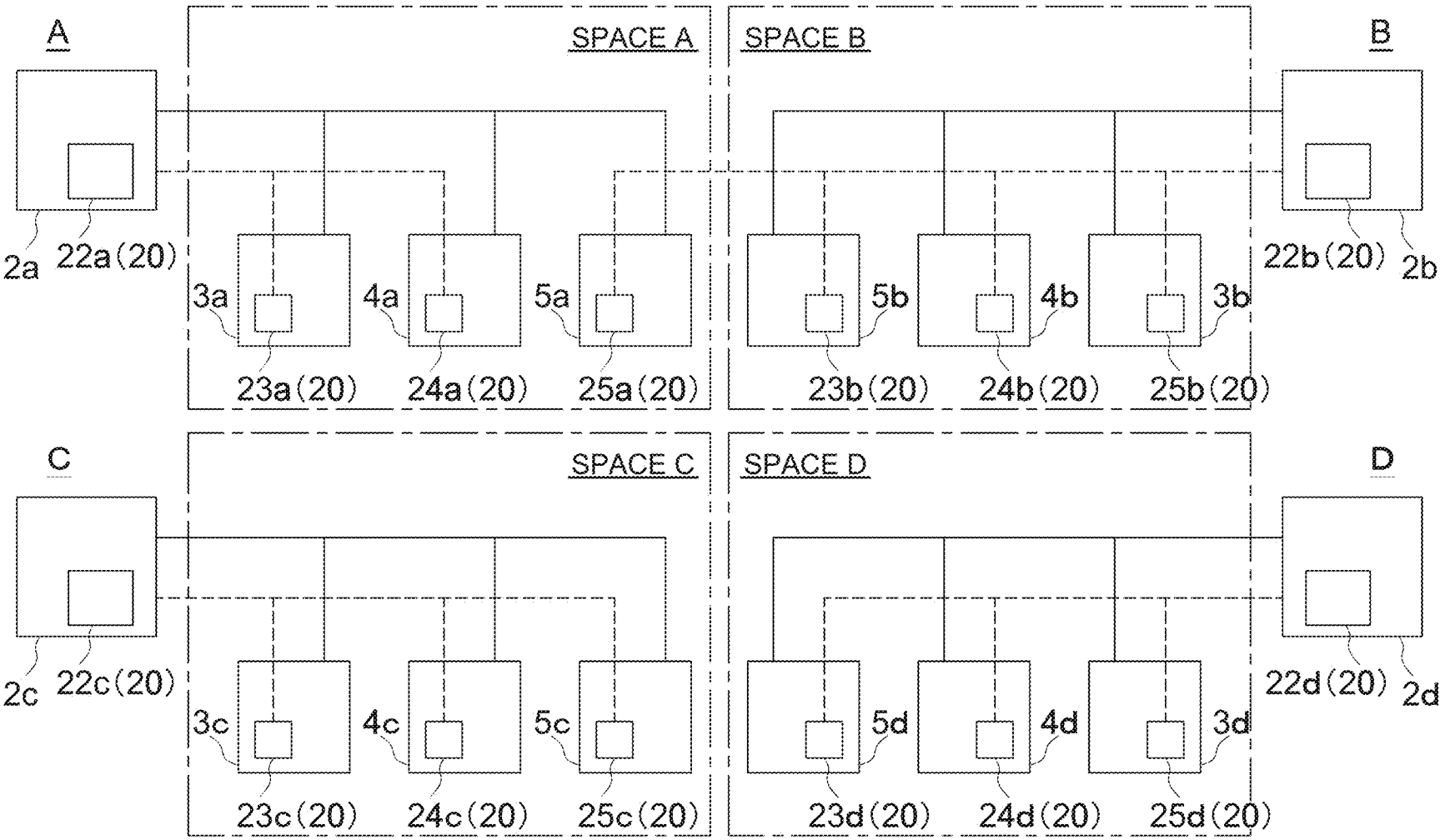
FIG. 2B is a general configuration diagram illustrating wrong wiring of the air conditioner.

FIG. 2B illustrates a state in which a wire of the refrigerant system B is wrongly connected to the indoor control unit 25*a* of the indoor unit 5*a*.

The wiring inspection is an inspection relating to whether or not each electric wire is properly connected.

In the wiring inspection, first, the control unit 20 sends an instruction to the outdoor control unit 22*a* to start an operation of the compressor. Then, the control unit 20 confirms that, in the refrigerant system A, the detection value of the temperature sensor that detects the temperature of the indoor air is a predetermined value set in advance.

In this case, as illustrated in FIG. 2B, when an abnormality occurs in connection of an electric wire, the detection value of the temperature sensor in the refrigerant system A does not reach the predetermined value set in advance.

The wiring inspection is desirably separately executed instead of being executed concurrently with the other inspections because the wiring inspection has a large influence on the other inspections.

(2-2-2) Shutoff Valve Inspection

In the shutoff valve inspection, the control unit 20 waits until a predetermined time has elapsed since a time point at which an operation of the compressor was started, and then recognizes the detection value or a change in the detection value of the pressure sensor on the suction side of the refrigerant system A and the detection value or a change in the detection value of the pressure sensor on the discharge side of the refrigerant system A, to inspect the opening degree of the shutoff valve. The control unit 20 judges whether or not the discharge pressure recognized at this time is in a state higher than a predetermined value, and whether or not the suction pressure recognized at this time is in a state lower than a predetermined judgement low-pressure value.

In this case, when an abnormality occurs in the shutoff valve inspection, the detection value of the pressure sensor on the discharge side is in a state higher than a predetermined high-pressure value.

The shutoff valve inspection can be executed concurrently with the other inspections because the shutoff valve inspection has a small influence on the other inspections.

(2-2-3) Refrigerant Filling Amount Inspection

In the refrigerant filling amount inspection, the control unit 20 performs processing of waiting until a state in which the degree of superheating of the refrigerant system is maintained at a target degree of superheating has continued for a predetermined time.

In the state in which the degree of superheating is continuously stable at the target degree of superheating over the predetermined time, the amount of refrigerant filled in the refrigerant circuit is calculated on the basis of information such as the detection values of the respective sensors of the refrigerant system and the rotational frequency of the compressor.

The refrigerant filling amount inspection can be executed concurrently with the other inspections because the refrigerant filling amount inspection has a small influence on the other inspections.

(3) Mobile Terminal 30

The mobile terminal 30 illustrated in FIG. 1 is an information terminal held by a user of the mobile terminal 30. As the mobile terminal 30, while a portable terminal such as a smartphone or a tablet personal computer, or a personal computer such as a laptop personal computer is expected, the mobile terminal 30 may be any other information processing apparatus.

The mobile terminal 30 includes a communication module, and is configured to be communicable with the management server 40 via a network. The mobile terminal 30 is connected to the network through one or both of wireless communication and wired communication.

The mobile terminal 30 includes a storage unit 31, an inspection apparatus designation unit 32, an input unit 33, a display unit 34, and a verification information transmission unit 35.

(3-1) Storage Unit 31

The storage unit 31 is constituted of memories such as a ROM, a RAM, a flash memory, and a hard disk included in any one or all of the components constituting the mobile terminal 30. The storage unit 31 has a plurality of storage areas including a volatile storage area that temporarily stores information and a non-volatile storage area that accumulates various pieces of information. The storage unit 31 stores verification information for verifying the user of the mobile terminal 30. The verification information includes, for example, identification information that is desirably or automatically given to the user, biological information of the user, identification information desirably or automatically given to the mobile terminal 30, positional information of the mobile terminal 30, and information relating to a preset password or the like.

(3-2) Inspection Apparatus Designation Unit 32

The inspection apparatus designation unit 32 designates a plurality of refrigerant systems in which the respective inspections are executed. Alternatively, the input unit 33, which will be described later, may also provide the function of the inspection apparatus designation unit 32. When the inspection apparatus designation unit 32 designates a refrigerant system, information on the designated refrigerant system is transmitted as designation information to the management server 40. When receiving the designation information, the management server 40 starts creating an inspection schedule.

(3-3) Input Unit 33

Figure 3:
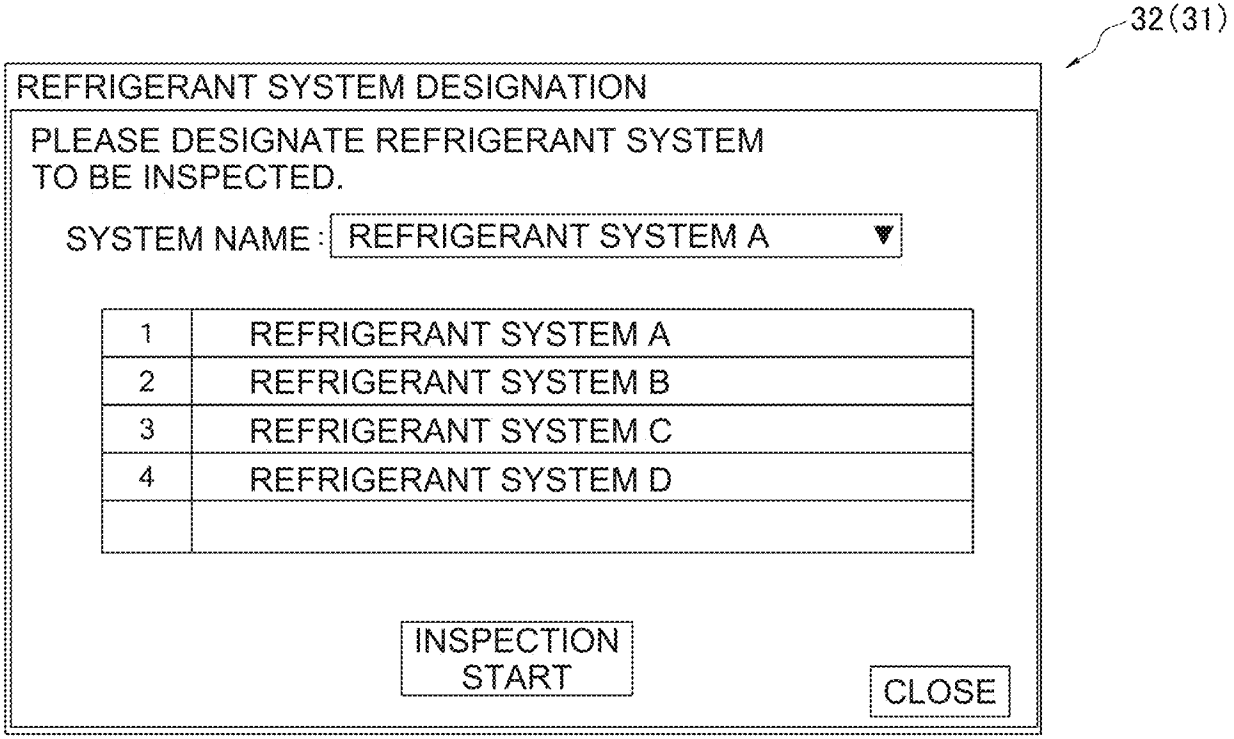
FIG. 3 presents an example of an input screen.

The input unit 33 is, for example, a touch panel and is a functional unit for inputting various instructions. By inputting an instruction from the input unit 33, the user can properly control the management server 40 or an operation of the air conditioner 1 that is communicable with the management server 40. For example, the input unit 33 may receive an input through an input screen that is displayed on the display unit 34, which will be described later. For example, FIG. 3 is an input screen for designation information when the input unit 33 functions as the inspection apparatus designation unit 32. Referring to FIG. 3, the input unit 33 has input therein the refrigerant systems A, B, C, and D as designation information.

(3-4) Display Unit 34

The display unit 34 displays various pieces of information. In the schedule creating system 100, the mobile terminal 30 can function as an output unit that displays information. The user can properly recognize an operating status of the schedule creating system 100 and information relating to an inspection through the display unit 34 of the mobile terminal 30. For example, the display unit 34 illustrated in FIG. 4A displays an inspection schedule, which will be described later, for the user of the mobile terminal 30. The display unit 34 illustrated in FIG. 5 displays abnormal information in a case where an abnormality occurs in an inspection.

(3-5) Verification Information Transmission Unit 35

The verification information transmission unit 35 transmits verification information of the user to the management server 40 to log in to the management server 40 from the mobile terminal 30.

(4) Management Server 40

The management server 40 illustrated in FIG. 1 is a computer that centrally manages operations of the schedule creating system 100. The management server 40 transmits and receives data to and from the air conditioner 1 and the mobile terminal 30. As illustrated in FIG. 1, the management server 40 includes functional units such as a storage unit 41, an extraction unit 42, an acquisition unit 43, a schedule determination unit 44, a schedule change unit 45, a response unit 46, an inspection instruction unit 47, and a verification information reception unit 48.

(4-1) Storage Unit 61

Figure 6:
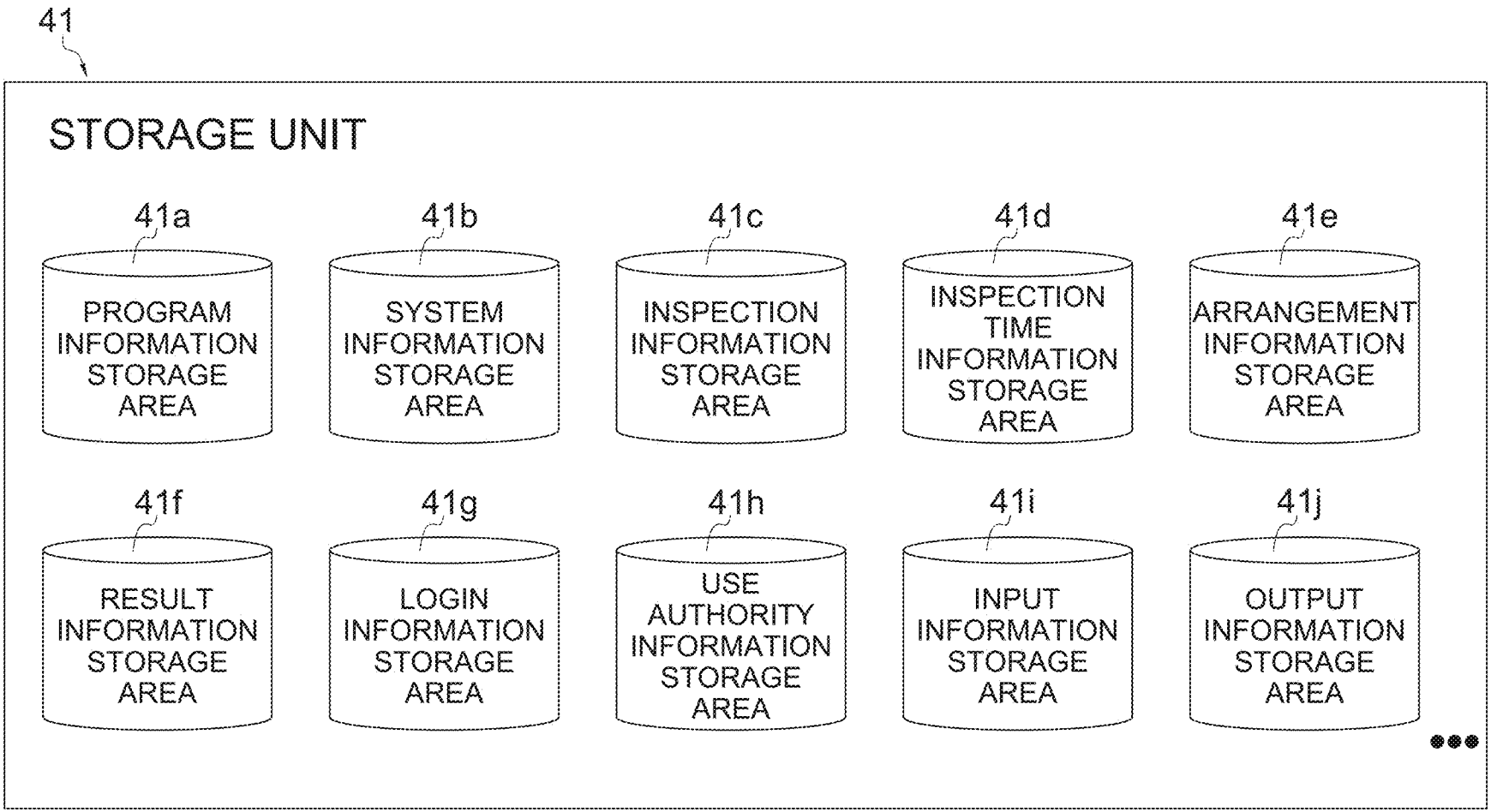
FIG. 6 is a schematic diagram of a storage unit.

The storage unit 41 is constituted of memories such as a ROM, a RAM, a flash memory, and a hard disk included in any one or all of the components constituting the management server 40. The storage unit 41 has a plurality of storage areas including a volatile storage area that temporarily stores information and a non-volatile storage area that accumulates various pieces of information. Specifically, as illustrated in FIG. 6, the storage unit 41 includes storage areas such as a program information storage area 41*a*, a system information storage area 41*b*, an inspection information storage area 41*c*, an inspection time information storage area 41*d*, an arrangement information storage area 41*e*, a result information storage area 41*f*, a verification information storage area 41*g*, a use authority information storage area 41*h*, an input information storage area 41*i*, and an output information storage area 41*j*. Various pieces of information stored in the respective storage areas can be properly changed.

The program information storage area 41*a* stores control programs that define various types of processing to be executed in the respective components of the management server 40, and communication protocols that are used for communication among the respective units.

The system information storage area 41*b* stores system information that is information relating to the refrigerant systems A, B, C, and D of the air conditioner 1 constructed in the target object. The system information includes information relating to, for example, names of the respective refrigerant systems; models and capacities of the outdoor units 2*a* to 2*d* and the indoor units 3*a* to 5*a*, 3*b* to 5*b*, 3*c* to 5*c*, and 3*d* to 5*d* included in the respective refrigerant systems; lengths of refrigerant pipes; and the numbers of the indoor units 3*a* to 5*a*, 3*b* to 5*b*, 3*c* to 5*c*, and 3*d* to 5*d*.

The inspection information storage area 41*c* stores inspection information that is information relating to each inspection to be executed by the air conditioner 1. The inspection information includes information relating to, for example, the type of each inspection to be executed by the air conditioner 1 and the influence on the other inspections. The information on the influence on the other inspections is information relating to the degree of influence on the other inspections when a specific inspection is executed concurrently with the other inspections. The inspection having a large influence on the other inspections is not able to be executed concurrently with the other inspections. The inspection having a small influence or no influence on the other inspections is able to be executed concurrently with the other inspections. For example, in this embodiment, the wiring inspection has a large influence on the other inspections, and the shutoff valve inspection and the refrigerant filling amount inspection have small influences on the other inspections.

The inspection time information storage area 41*d* stores inspection time information that is information relating to a time required for each inspection to be executed by the air conditioner 1. The inspection time information includes information relating to a fixed inspection time set in advance for each inspection, a variable inspection time that changes depending on each condition of the refrigerant system, and the like. The variable inspection time is an inspection time that changes depending on conditions such as models of apparatuses included in the refrigerant system, capacities of the apparatuses, the lengths of refrigerant pipes, and the numbers of the indoor units 3*a* to 5*a*, 3*b* to 5*b*, 3*c* to 5*c*, and 3*d* to 5*d*. The inspection time storage area M45 stores information for calculating a variable inspection time.

The arrangement information storage area 41*e* stores arrangement information that is information relating to arrangement of the air conditioner 1 in the target object in which the air conditioner 1 is constructed. The arrangement information includes, for example, information relating to a drawing of the target object and arrangement of the apparatuses in the drawing of the target object.

The result information storage area 41*f* stores result information acquired from the inspection result output unit 28 of the air conditioner 1.

The verification information storage area 41*g* stores verification information for verifying verification authority when the user of the mobile terminal 30 is verified by the management server 40 via the network. The verification information includes identification information that is desirably or automatically given to the user, biological information of the user, identification information desirably or automatically given to the mobile terminal 30, positional information of the mobile terminal 30, and information relating to a preset password or the like.

The use authority information storage area 41*h* stores use authority information that is information in a range of authority to be able to use the management server 40. The use authority information is stored in association with information such as identification information given to the user and identification information given to the mobile terminal 30.

The input information storage area 41*i* stores information input to the management server 60. For example, the input information storage area 41*i* stores a command input through the mobile terminal 30.

The output information storage area 41*j* stores information to be transmitted from the management server 60 to another apparatus. For example, a transmission information storage area M49 stores an inspection schedule that is illustrated in FIG. 4A and transmitted to the mobile terminal 30.

(4-2) Extraction Unit 42

The extraction unit 42 extracts information required for each processing that is executed by a corresponding functional unit from information stored in the storage unit 41.

(4-3) Acquisition Unit 43

The acquisition unit 43 performs processing of acquiring information that is input to the management server 40 and storing the acquired information in the storage unit 41. For example, the acquisition unit 43 acquires an instruction input through the mobile terminal 30 and designation information and stores the instruction and the designation information in the input information storage area 41*i*. Alternatively, the acquisition unit 43 acquires an inspection result transmitted from the air conditioner 1 and stores the inspection result in the result information storage area 41*f*.

(4-4) Schedule Determination Unit 44

The schedule determination unit 44 includes an inspection time prediction unit 44*a*, a concurrent execution judgment unit 44*b*, and a determination unit 44*c*. It is assumed that, in this embodiment, the inspection apparatus designation unit 32 of the mobile terminal 30 designates the refrigerant systems A, B, C, and D.

(4-4-1) Inspection Time Prediction Unit 44*a*

The inspection time prediction unit 44*a* performs processing of predicting an inspection time required for inspecting the refrigerant systems A, B, C, and D included in the designation information acquired by the acquisition unit 43. The inspection time is a time required for executing an inspection.

The inspection time prediction unit 44*a* predicts the inspection time on the basis of information stored in the system information storage area 41*b*, the inspection information storage area 41*c*, and the inspection time information storage area 41*d*. The processing of calculating the inspection time by the inspection time prediction unit 44*a* is performed using predetermined means including a known technique.

(4-4-2) Concurrent Execution Judgment Unit 44*b*

The concurrent execution judgment unit 44*b* performs processing of judging whether or not respective inspections that are to be executed on the refrigerant systems A, B, C, and D included in the designation information acquired by the acquisition unit 43 are executable concurrently with each other.

The concurrent execution judgment unit 44*b* performs processing of judging whether or not each inspection is executable concurrently with the other inspections on the basis of information stored in the system information storage area 41*b*, the inspection information storage area 41*c*, and the arrangement information storage area 41*e*. For example, the concurrent execution judgment unit 44*b* judges that the shutoff valve inspection and the refrigerant filling amount inspection are concurrently executable on the basis of information relating to the influences given to the other inspections stored in the inspection information storage area 41*c*. Furthermore, the concurrent execution judgment unit 44*b* judges that concurrent execution is available for the refrigerant system A and the refrigerant system B and concurrent execution is available for the refrigerant system C and the refrigerant system D on the basis of information stored in the arrangement information storage area 41*e*.

(4-4-3) Determination Unit 44*c*

The determination unit 44*c* performs processing of determining the order of respective inspections that are to be executed on the refrigerant systems A, B, C, and D included in designation information received by the acquisition unit 43.

Figure 4B:
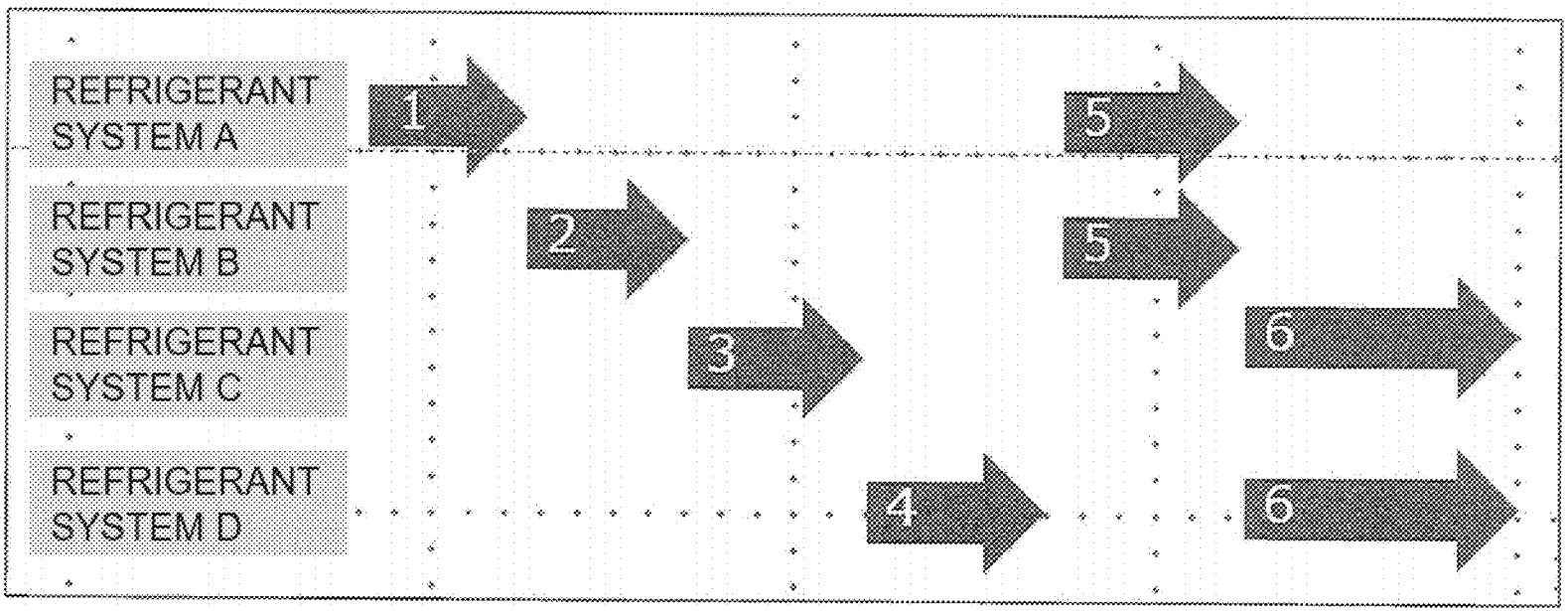
FIG. 4B is a schematic chart of the inspection schedule.

The determination unit 44*c* performs processing of determining the inspection schedule on the basis of the processing of the inspection time prediction unit 44*a* and the concurrent execution judgment unit 44*b*. In this embodiment, the inspection schedule is determined so as to minimize the time required for completion of all inspections in all refrigerant systems A, B, C, and D. The inspection schedule determined by the determination unit 44*c* is stored in the output information storage area 41*j*. The inspection schedule determined by the determination unit 44*c* is, for example, a schedule presented in FIG. 4A. FIG. 4B is a chart presenting the determined inspection schedule in time sequence.

(4-5) Schedule Change Unit 45

The schedule change unit 45 performs processing of changing the inspection schedule when normal information is stored in the result information storage area 41*f*.

Specifically, when a new inspection result stored in the result information storage area 41*f* is normal information, the schedule change unit 45 causes information indicative of that the inspection has been normally ended to be stored in the output information storage area 41*j*. Then, the schedule change unit 45 causes the schedule determination unit 44 to determine a new inspection schedule for remaining inspections that have not been executed yet. The schedule change unit 45 causes the new inspection schedule determined by the schedule determination unit 44 to be stored in the output information storage area 41*j*.

(4-6) Response Unit 46

Figure 5:
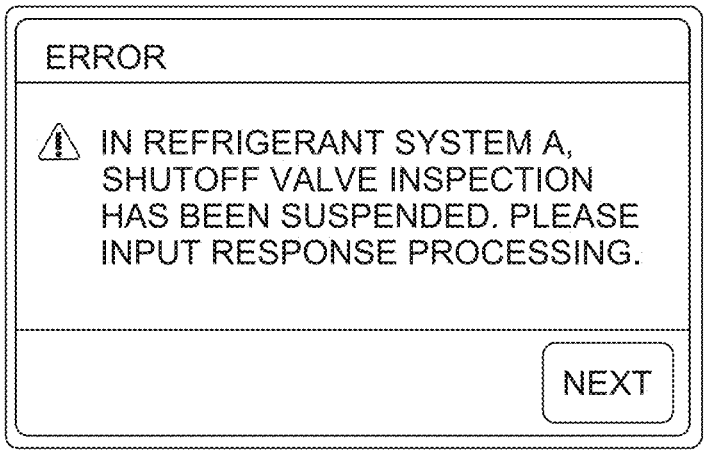
FIG. 5 presents an example of abnormal information.

When abnormal information is stored in the result information storage area 41*f*, the response unit 46 causes the schedule determination unit 44 to determine a pending schedule. It is assumed that, in this embodiment, an abnormality occurs in the refrigerant system D as illustrated in FIG. 5.

Specifically, when the new inspection result stored in the result information storage area 41*f* is abnormal information, information indicative of that the inspection is suspended is stored in the output information storage area 41*j*. Then, the response unit 46 causes the schedule determination unit 44 to determine a pending schedule that is an inspection schedule for only refrigerant systems excluding the refrigerant system D in which the suspended inspection was being executed. In this case, a pending schedule for the refrigerant systems A, B, and C excluding the refrigerant system D is determined. The determined pending schedule is stored in the output information storage area 41*j*. The pending schedule is, for example, a schedule as presented in FIG. 7.

Furthermore, the response unit 46 performs processing of changing the inspection schedule when the acquisition unit 43 of the management server 40 receives response information. Specifically, the response unit 46 adds response processing to the types of inspection of the refrigerant system D, and causes the schedule determination unit 44 to determine a new inspection schedule. At this time, the concurrent execution judgment unit 44*b* judges whether or not the response processing is executable concurrently with the other inspections. The determined new inspection schedule is stored in the output information storage area 41*j*.

(4-7) Inspection Instruction Unit 47

The inspection instruction unit 47 transmits an inspection instruction for an inspection that is to be executed next to the air conditioner 1 when the inspection schedule is stored in the output information storage area 41*j*. For example, in the inspection schedule in FIG. 7, the inspection to be executed next is a wiring inspection in the refrigerant system D.

(4-8) Verification Information Reception Unit 48

The verification information reception unit 48 verifies verification information that is received when the mobile terminal 30 logs in to the management server 40. The verification information reception unit 48 verifies the mobile terminal 30 or the user of the mobile terminal 30 by comparing the verification information transmitted from the mobile terminal 30 with the verification information stored in the verification information storage area 41*g* during verification. Furthermore, the verification information reception unit 48 performs processing of enabling control on an apparatus in the range of the use authority of the user on the basis of use authority information stored in the use authority information storage area 41*h* in association with the verification information.

(5) Flow of Processing Relating to Inspection by Management Server 40

Hereinafter, an example of a flow of processing relating to an inspection by the management server 40 is described with reference to FIG. 8. The flow of processing presented in FIG. 8 can be properly changed. The order of any one of steps may be switched, some steps may be simultaneously executed, or another step which is not illustrated may be added as long as processing is properly performed.

(5-1) Flow of Processing in Normal Situation

Described below with reference to FIG. 13 is an example flow of processing of determining an inspection schedule performed by the management server 40 and processing when all inspection results are normal.

Figure 8:
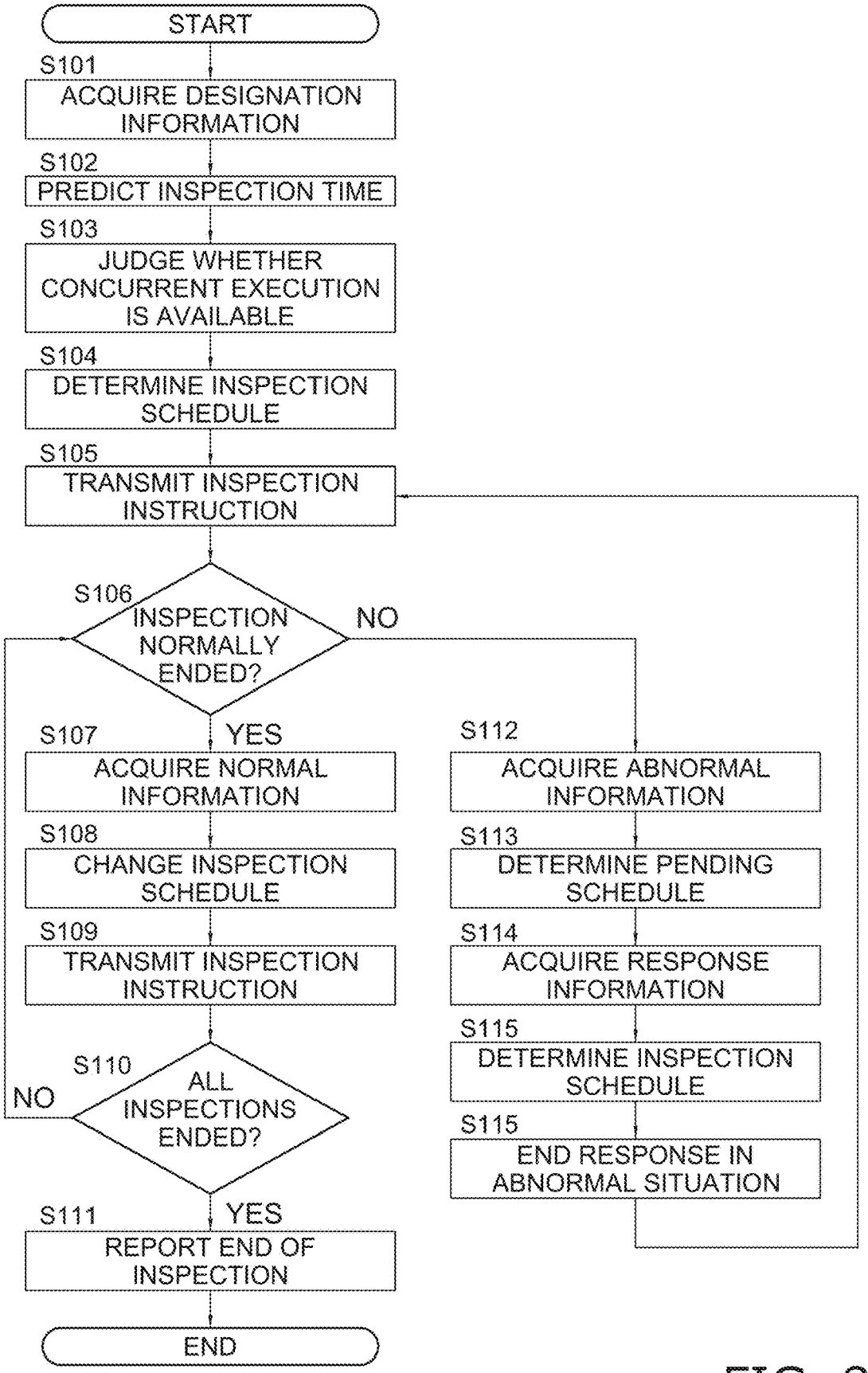
FIG. 8 is a flowchart of a flow of inspection processing executed by a management server.

The management server 40 executes processing according to a flow from step S101 to step S111 in FIG. 8.

In step S101, the management server 40 acquires designation information from the mobile terminal 30. The management server 40 starts creating an inspection schedule on the basis of the acquired designation information.

Specifically, first, the user of the mobile terminal 30 designates a plurality of refrigerant systems in which inspections are to be executed from the inspection apparatus designation unit 32 of the mobile terminal 30. Information on the designated refrigerant systems is transmitted as designation information to the acquisition unit 43 of the management server 40 via the network. The acquisition unit 43 stores the received designation information in the input information storage area 41*i*. The extraction unit 42 of the management server 40 extracts information relating to the inspections that are to be executed by the designated refrigerant systems from each information area of the storage unit 41.

In step S102, the inspection time prediction unit 44*a* of the management server 40 performs processing of predicting the inspection time of the refrigerant systems on the basis of the information extracted by the extraction unit 42.

In step S103, the concurrent execution judgment unit 44*b* of the management server 40 performs processing of judging whether or not the respective inspections are executable concurrently with each other on the basis of the information extracted by the extraction unit 42.

In step S104, the management server 40 determines an inspection schedule on the basis of the processing in step S102 and step S103, and transmits the determined inspection schedule to the mobile terminal 30.

Specifically, the schedule determination unit 44 of the management server 40 performs processing of determining the inspection schedule on the basis of the processing of the inspection time prediction unit 44*a* and the concurrent execution judgment unit 44*b*. In this embodiment, the inspection schedule is determined so as to minimize the inspection time. The inspection schedule determined by the schedule determination unit 44 is stored in the output information storage area 41*j*. The inspection schedule is, for example, a determination schedule presented in FIG. 4A. The management server 40 transmits the inspection schedule to the mobile terminal 30 via the network. The mobile terminal 30 displays the received inspection schedule on the display unit 34. The user of the mobile terminal 30 confirms the displayed inspection schedule, and inputs instructions of executing the respective inspections on the basis of the inspection schedule using the input unit 33.

In step S105, the management server 40 transmits an inspection instruction for an inspection that is to be executed by the air conditioner 1 next.

Specifically, first, the inspection instruction unit 47 of the management server 40 transmits the inspection instruction for the inspection that is to be executed by the air conditioner 1 next to the execution instruction reception unit 25 of the air conditioner 1 via the network. The inspection that is to be executed by the air conditioner 1 next is determined on the basis of the inspection schedule stored in the output information storage area 41*j* of the storage unit 41. In this case, when there are a plurality of inspections to be executed next, the inspection instruction unit 47 transmits an inspection instruction indicative of that the plurality of inspections are to be concurrently executed to the execution instruction reception unit 25. The air conditioner 1 executes the inspections on the basis of the received inspection instruction. The inspection result judgment unit 27 of the air conditioner 1 judges whether or not each detection value of a sensor or the like acquired in the inspection being executed by the inspection execution unit 26 is normal, and generates result information. The inspection result output unit 28 of the air conditioner 1 transmits the result information to the acquisition unit 43 of the management server 40 via the network.

In step S106, when the result information received by the management server 40 is normal information, the processing goes to step S107. When the result information received by the management server 40 is abnormal information, the processing goes to step S112.

Described next is the case where the result information received by the management server 40 is normal information in step S107. The management server 40 acquires normal information that is the inspection result of the executed inspection from the air conditioner 1, and stores the normal information in the storage unit 41.

Specifically, the acquisition unit 43 of the management server 40 acquires the normal information from the inspection result output unit 28 of the air conditioner 1 via the network. The normal information acquired by the acquisition unit 43 is stored in the result information storage area 41*f*.

In step S108, the management server 40 changes the inspection schedule.

Specifically, the schedule change unit 45 causes the schedule determination unit 44 to determine a new inspection schedule for remaining inspections that have not been executed yet. The schedule change unit 45 causes the new inspection schedule determined by the schedule determination unit 44 to be stored in the output information storage area 41*j*. The management server 40 transmits the new inspection schedule to the mobile terminal 30.

In step S109, the management server 40 transmits an inspection instruction for an inspection that is to be executed by the air conditioner 1 next on the basis of the new inspection schedule stored in the storage unit 41. The processing of transmitting the inspection instruction from the management server 40 to the air conditioner 1 is similar to that in step S105.

In step S110, the management server 40 repeats the processing from step S106 to step S109 until all inspections of all refrigerant systems designated by the inspection apparatus designation unit 32 of the mobile terminal 30 have been completed.

In step S111, when all inspections in all refrigerant systems have been completed, the management server 40 transmits a report indicative of that all inspections have been completed to the mobile terminal 30. The mobile terminal 30 displays this report on the display unit 34 and causes the user to confirm the report.

(5-2) Flow of Response Processing in Abnormal Situation

An example of a flow of processing when abnormal information is acquired in step S106 is described.

The management server 40 executes processing according to a flow from step S112 to step S115.

When the abnormal information is acquired in step S106, in step S112, the management server 40 acquires the abnormal information from the air conditioner 1, and stores the abnormal information in the storage unit 41.

Specifically, the acquisition unit 43 of the management server 40 acquires the abnormal information from the inspection result output unit 28 of the air conditioner 1 via the network. The abnormal information acquired by the acquisition unit 43 is stored in the result information storage area 41*f*. At this time, the inspection result judgment unit 27 of the air conditioner 1 suspends the inspection being executed by the inspection execution unit 26.

In step S113, the management server 40 brings the refrigerant system in which the suspended inspection was being executed into a pending state, and causes the inspections to be executed based on the pending schedule in the refrigerant systems excluding the refrigerant system in which the suspended inspection was being executed.

Specifically, the response unit 46 of the management server 40 causes the schedule determination unit 44 to determine a pending schedule that is an inspection schedule for only the refrigerant systems excluding the refrigerant system in which the suspended inspection was being executed. The determined pending schedule is stored in the output information storage area 41*j*. The inspection instruction unit 47 transmits an inspection instruction for an inspection that is to be executed by the air conditioner 1 next to the execution instruction reception unit 25 of the air conditioner 1 via the network on the basis of the pending schedule. The inspection execution unit 26 of the air conditioner 1 executes the inspection on the basis of the inspection instruction.

In step S114, the management server 40 transmits the abnormal information to the mobile terminal 30. The management server 40 acquires response information that is information on response processing to respond to the abnormality from the mobile terminal 30.

Specifically, first, the abnormal information stored in the result information storage area 41*f* of the management server 40 is transmitted to the mobile terminal 30 via the network. At this time, the management server 40 may simultaneously transmit the pending schedule. The mobile terminal 30 displays the abnormal information on the display unit 34 and causes the user to confirm the abnormal information. The user inputs response information using the input unit of the mobile terminal 30. For example, the response information may be information relating to a predetermined response method stored in the management server 40 in advance, or may be information that is newly input by the user of the mobile terminal 30. The response information is transmitted to the acquisition unit 43 of the management server 40 via the network. The received response information is stored in association with the abnormal information stored in the result information storage area 41*f*.

In step S115, the management server 40 creates a new inspection schedule including response processing included in the response information.

Specifically, the response unit 46 of the management server 40 adds response processing to the types of inspection of the refrigerant system D, and causes the schedule determination unit 44 to determine a new inspection schedule. The determined new inspection schedule is stored in the output information storage area 41*j* of the storage unit 41. The inspection instruction unit 47 of the management server 40 transmits an instruction for an inspection or for response processing that is to be executed by the air conditioner 1 next to the execution instruction reception unit 25 of the air conditioner 1 via the network on the basis of the new inspection schedule. The inspection execution unit 26 of the air conditioner 1 executes the inspection or the response processing on the basis of the instruction.

In step S115, the response processing in the abnormal situation is ended and the processing goes to step S105.

(6) Modifications (6-1) Modification 1

The determination unit 44*c* of the schedule determination unit 44 determines an inspection schedule so as to minimize the time taken until all inspections in all refrigerant systems have been completed. Alternatively, the determination unit 44*c* may determine an inspection schedule to execute inspections in order from an inspection whose abnormality response time is long. The abnormality response time is a time required for executing a necessary response when an abnormality occurs in an inspection result. At this time, the abnormality response time or information for calculating the abnormality response time is stored in the inspection information storage area 41*c* or the inspection time information storage area 41*d* of the storage unit 41.

(6-2) Modification 2

In this embodiment, the user may use a remote controller belonging to the air conditioner 1 instead of the mobile terminal 30. The remote controller includes an instruction unit, a reception unit, and an output unit. The instruction unit of the remote controller inputs designation information and inputs an instruction to the management server 40. The reception unit acquires information from the management server 40. The output unit displays information to the user.

(6-3) Modification 3

In this embodiment, the management server 40 and the air conditioner 1 are connected to a network. In this case, the management server 40 and the air conditioner 1 may be connected to a wide area network such as WAN or may be connected to a wide area network such as LAN. The management server 40 may be used in a cloud or the like.

(7) Features (7-1)

The inspection execution method of this embodiment is an inspection execution method performed by a computer, for causing each of air conditioners 1 serving as a plurality of apparatuses to execute a plurality of inspections. The inspection execution method includes a schedule determination step and an inspection execution step. The schedule determination step determines an inspection schedule including at least order of the plurality of inspections. The inspection execution step causes the apparatuses to execute the inspections on the basis of the determined inspection schedule.

Accordingly, it is possible to efficiently execute the plurality of inspections.

(7-2)

The inspection execution method of this embodiment determines the inspection schedule to execute one of the inspections with an abnormality response time being long before another one of the inspections with the abnormality response time being short. The abnormality response time is a time required for executing a necessary response when an abnormality occurs in inspection results that are results of the inspections.

Accordingly, even when an abnormality occurs in the inspections, it is possible to efficiently execute the plurality of inspections.

(7-3)

In the inspection execution method of this embodiment, the inspections include a first-type inspection and a second-type inspection, the first-type inspection of one of the air conditioners 1 having no influence or a small influence on results of the inspections of the other air conditioners 1, the second-type inspection having a larger influence than the influence of the first-type inspection. The inspection schedule is determined to concurrently execute the first-type inspection having the small influence.

Accordingly, it is possible to decrease the time required for the plurality of inspections, and it is possible to efficiently execute the plurality of inspections.

(7-4)

In the inspection execution method of this embodiment, the air conditioners 1 each are a refrigerant cycle apparatus configured such that indoor units 3*a* to 5*a*, 3*b* to 5*b*, 3*c* to 5*c*, 3*d* to 5*d* serving as a plurality of use units are connected to an outdoor unit 2*a*, 2*b*, 2*c*, 2*d* serving as a heat source unit. The inspections include an inspection for a refrigerant filling amount of a refrigerant filled in the air conditioner 1 and an inspection for wiring to check whether or not wiring for connecting the outdoor unit 2*a*, 2*b*, 2*c*, 2*d* with the indoor units 3*a* to 5*a*, 3*b* to 5*b*, 3*c* to 5*c*, 3*d* to 5*d* is proper.

(7-5)

In the inspection execution method of this embodiment, the schedule determination step makes a determination on the basis of arrangement information that is information on arrangement of the plurality of air conditioners 1.

(7-6)

The inspection execution method of this embodiment further includes an inspection time prediction step of predicting an inspection time that is a time required for executing each of the inspections. The schedule determination step determines the inspection schedule on the basis of the predicted inspection time.

(7-7)

The inspection execution method of this embodiment further includes an inspection result storage step and an inspection result display step. The inspection result storage step stores inspection results that are results of the inspections. The inspection result display step displays the inspection results.

(7-8)

The inspection execution method of this embodiment further includes an inspection result judgment step and an inspection suspension method. The inspection result judgment step judges whether or not inspection results are normal. The inspection suspension step suspends the inspections when the inspection results of the inspection result judgment step are not normal.

(7-9)

The inspection execution method of this embodiment further includes a schedule change step of changing the inspection schedule on the basis of a progress status of the inspection step.

(7-10)

A management server 40 of this embodiment is a management server connected to a computer for causing each of a plurality of air conditioners 1 each configured such that a plurality of indoor units 3*a* to 5*a*, 3*b* to 5*b*, 3*c* to 5*c*, 3*d* to 5*d* are connected to an outdoor unit 2*a*, 2*b*, 2*c*, 2*d* to execute a plurality of inspections. The management server 40 includes a schedule determination unit 44 and an inspection instruction unit 47. The schedule determination unit 44 includes at least order of the plurality of inspections. The inspection instruction unit 47 instructs execution of the inspections on the basis of the determined inspection schedule.

Accordingly, it is possible to efficiently execute the plurality of inspections.

(7-11)

The management server 40 of this embodiment further includes a storage unit 41 and a verification information reception unit 48 serving as a verification unit. The storage unit 41 stores verification information with which users who use the management server 40 are verified. The verification information reception unit 48 verifies the verification information with each of the users.

(7-12)

A mobile terminal 30 of this embodiment is a mobile terminal 30 connected to a computer for causing each of a plurality of air conditioners 1 each configured such that a plurality of indoor units 3*a* to 5*a*, 3*b* to 5*b*, 3*c* to 5*c*, 3*d* to 5*d* are connected to an outdoor unit 2*a*, 2*b*, 2*c*, 2*d* to execute a plurality of inspections. The mobile terminal 30 includes an inspection apparatus designation unit 32 and a display unit 34. The inspection apparatus designation unit 32 designates the apparatuses that are targets of the inspections. The display unit 34 displays results of the inspections.

Accordingly, it is possible to efficiently execute the plurality of inspections.

(7-13)

In an air conditioner 1 serving as a refrigerant cycle apparatus of this embodiment, a plurality of indoor units 3*a* to 5*a*, 3*b* to 5*b*, 3*c* to 5*c*, 3*d* to 5*d* are connected to an outdoor unit 2*a*, 2*b*, 2*c*, 2*d*. The air conditioner 1 includes an execution instruction reception unit 25, an inspection execution unit 26, and an inspection result output unit 28. The execution instruction reception unit 25 receives an inspection instruction for causing the air conditioner 1 to execute a plurality of inspections. The inspection execution unit 26 executes the inspections when the execution instruction reception unit 25 receives the inspection instruction. The inspection result output unit 28 outputs results of the inspections executed by the inspection execution unit 26.

(7-14)

The mobile terminal 30 of this embodiment further includes a storage unit 31 configured to store verification information for verifying a user who uses the mobile terminal. The verification information includes at least one of individual identification information, a password, mobile terminal identification information, and mobile terminal positional information.

(8)

The embodiments of the present disclosure have been described above, and it is understood that the embodiments and details can be modified in various ways without departing from the gist and scope of the present disclosure described in the claims.

What is claimed is:

1. An inspection execution method performed by a computer to cause each of a plurality of apparatuses to execute a plurality of inspections, the inspection execution method comprising:

determining an inspection schedule including at least an order of the plurality of inspections; and causing the apparatuses to execute the inspections based on the determined inspection schedule, the determining the inspection schedule determines the inspection schedule to execute one of the inspections before an other one of the inspections, the one of the inspections having an abnormality response time longer than an abnormality response time of the other of the inspections, each abnormality response time being a time required to execute a necessary response when an abnormality occurs in inspection results that are results of the inspections.

2. The inspection execution method according to claim 1, wherein the determining the inspection schedule makes a determination based on arrangement information on arrangement of the plurality of apparatuses.

3. The inspection execution method according to claim 1, further comprising:

predicting an inspection time required to execute each of the inspections, the determining the inspection schedule being based on the predicted inspection time.

4. The inspection execution method according to claim 1, further comprising:

storing inspection results of the inspections; and displaying the inspection results.

5. The inspection execution method according to claim 1, wherein the inspections include a first-type inspection and a second-type inspection, the first-type inspection of one of the apparatuses having no influence or a small influence on results of the inspections of the other apparatuses, and the second-type inspection having a larger influence than the influence of the first-type inspection, and the inspection schedule is determined to concurrently execute the first-type inspection.

6. The inspection execution method according to claim 1, wherein each of the apparatuses is a refrigerant cycle apparatus configured such that a use unit is connected to a heat source unit, and the inspections include an inspection of a refrigerant filling amount of a refrigerant filled in the refrigerant cycle apparatus and an inspection of wiring to check whether connecting the heat source unit with the use unit is proper.

7. The inspection execution method according to claim 1, further comprising:

judging whether the inspection results are normal; and suspending the inspections when the inspection results of the inspection result judgment step are not normal.

8. An inspection execution method performed by a computer to cause each of a plurality of apparatuses to execute a plurality of inspections, the inspection execution method comprising:

determining an inspection schedule including at least an order of the plurality of inspections; and causing the apparatuses to execute the inspections based on the determined inspection schedule, the inspections including a first-tripe inspection and a second-type inspection, the first-type inspection of one of the apparatuses having no influence or a small influence on results of the inspections of the other apparatuses, and the second-type inspection having a larger influence than the influence of the first-type inspection, and the inspection schedule being determined to concurrently execute the s inspection.

9. An inspection execution method performed by a computer to cause each of a plurality of apparatuses to execute a plurality of inspections, the inspection execution method comprising:

determining an inspection schedule including at least an order of the plurality of inspections; and causing the apparatuses to execute the inspections based on the determined inspection schedule, each of the apparatuses being a refrigerant cycle apparatus configured such that a use unit is connected to a heat source unit, and the inspections including an inspection of a refrigerant filling amount of a refrigerant filled in the refrigerant cycle apparatus and an inspection of wiring to check whether connecting the heat source unit with the use unit is proper.

10. An inspection execution method performed by a computer to cause each of a plurality of apparatuses to execute a plurality of inspections, the inspection execution method comprising:

determining an inspection schedule including at least an order of the plurality of inspections;

causing the apparatuses to execute the inspections based on the determined inspection schedule, judging whether the inspection results are normal; and suspending the inspections when the inspection results of the inspection result judgment step are not normal.

11. An inspection execution method performed by a computer to cause each of a plurality of apparatuses to execute a plurality of inspections, the inspection execution method comprising:

determining an inspection schedule including at least an order of the plurality of inspections;

causing the apparatuses to execute the inspections based on the determined inspection schedule, and changing the inspection schedule based on a progress status of the inspection step.

12. A management server connected to a computer to cause each of a plurality of refrigerant cycle apparatuses, each refrigerant cycle apparatus being configured such that use units are connected to a heat source unit to execute a plurality of inspections, the management server comprising:

a schedule determination unit configured to determine an inspection schedule including at least order of the plurality of inspections; and an inspection instruction unit configured to instruct execution of the inspections based on the determined inspection schedule, the inspections including a first-type inspection and a second-type inspection, the first-type inspection of one of the apparatuses having no influence or a small influence on results of the inspections of the other apparatuses, and the second-type inspection having a larger influence than the influence of the first-type inspection, and the inspection schedule being determined to concurrently execute the first-type inspection.

13. The management server according to claim 12, further comprising:

a storage unit configured to store verification information with which users who use the management server are verified; and a verification unit configured to verify the verification information with each of the users.

* * * * *